US009150023B2

(12) United States Patent
Okamoto et al.

(10) Patent No.: US 9,150,023 B2
(45) Date of Patent: Oct. 6, 2015

(54) RECORDING APPARATUS

(71) Applicant: SEIKO EPSON CORPORATION, Tokyo (JP)

(72) Inventors: Katsumi Okamoto, Azumino (JP); Yasuhiro Matsuo, Matsumoto (JP); Masaki Shimomura, Matsumoto (JP); Satoshi Iwaya, Ina (JP); Atsushi Takei, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/482,987

(22) Filed: Sep. 10, 2014

(65) Prior Publication Data

US 2015/0091988 A1 Apr. 2, 2015

(30) Foreign Application Priority Data

Sep. 30, 2013 (JP) ..... 2013-203488
Feb. 19, 2014 (JP) ..... 2014-029348

(51) Int. Cl.
*B41J 29/13* (2006.01)
*B41J 2/175* (2006.01)

(52) U.S. Cl.
CPC ..... *B41J 2/1752* (2013.01)

(58) Field of Classification Search
CPC .. B41J 2/1752; B41J 2/17553; B41J 1/17513; B41J 1/17503; B41J 1/17509; B41J 1/17536; B41J 29/02
USPC ..... 347/37, 84–87, 101, 104, 108, 109
See application file for complete search history.

(56) References Cited

U.S. PATENT DOCUMENTS 6,293,662 B1 * 9/2001 Shihoh et al. ..... 347/86
7,686,441 B2 * 3/2010 Hashii et al. ..... 347/86
7,871,156 B2 * 1/2011 Usui et al. ..... 347/86

FOREIGN PATENT DOCUMENTS

JP 2009-202346 9/2009

* cited by examiner

*Primary Examiner* — An Do
(74) *Attorney, Agent, or Firm* — Workman Nydegger

(57) ABSTRACT

A recording apparatus includes a recording head capable of ejecting ink to a sheet; a sheet cassette that holds the sheet; a transport unit that transports the sheet to the recording head; a chassis which contains the recording head and the transport unit and into which the sheet cassette is inserted; an insertion port which is formed in a side surface of the chassis and through which the sheet cassette is inserted; an ink container that contains the ink; a case which is mounted on at least one side surface adjacent to the side surface in which the insertion port of the chassis is formed and accommodates the ink container; and a supply unit (connection tube) that supplies the ink from the ink container to an inside of the chassis. A guard portion with higher rigidity than the case is formed on a lower side of the case.

13 Claims, 8 Drawing Sheets

RECORDING APPARATUS

BACKGROUND

1. Technical Field

The present invention relates to a recording apparatus.

2. Related Art

In the past, an ink jet printer which performs printing by ejecting ink from a recording head to a sheet or the like has been known as a kind of recording apparatus. For such an ink jet printer, a configuration in which an external ink supply device (liquid supply device) supplying ink to a printer head is included separately from an apparatus body of the ink jet printer has been suggested in order to stably and continuously supply ink to the printer head when a relatively large amount of printing is performed (for example, see JP-A-2009-202346).

Such a liquid supply device includes a case accommodating an ink pack (liquid container) with a large capacity therein, and thus ink is supplied by an ink supply tube allowing the ink pack to communicate with a printer head inside the apparatus body.

Such an ink jet printer includes a case separately from the apparatus body. Therefore, when a user attempts to move the ink jet printer, the user has to hold and move the apparatus body and the case separately. Therefore, there is a method of moving the ink jet printer in a state in which the case is mounted on the apparatus body.

When the user moves the ink jet printer, the user attempts to grasp and lift the lower portion of the case mounted to the outside of the apparatus body with his or her fingers to move the ink jet printer. Therefore, rigidity of the case has to be high so that the case is not deformed or damaged.

However, in order to improve the rigidity of the case, there is a problem that manufacturing cost of the ink jet printer including the case increases.

SUMMARY

The invention can be realized in the following forms or application examples.

Application Example 1

According to Application Example 1, there is provided a recording apparatus including: a recording head that is able to eject a liquid to a recording medium; a recording medium holding unit that holds the recording medium; a transport unit that transports the recording medium to the recording head; a chassis which contains the recording head and the transport unit and into which the recording medium holding unit is inserted; an insertion port which is formed in a side surface of the chassis and through which the recording medium holding unit is inserted; a liquid container that contains the liquid; each case that is mounted on at least one side surface adjacent to the side surface in which the insertion port of the chassis is formed and accommodates the liquid container; and a supply unit that supplies the liquid from the liquid container to an inside of the chassis. A guard portion with higher rigidity than the case is formed on a lower side of the case.

According to this application example, the guard portion with the higher rigidity than the case is formed on a lower side of the case. Thus, the case can be prevented from being deformed or damaged when a user grasps the guard portion with his or her hand, and then lifts and moves the recording apparatus in which the case is mounted on the chassis. Therefore, since the rigidity of the case may not be high, it is possible to suppress an increase in the manufacturing cost of the recording apparatus including the case.

Application Example 2

In the recording apparatus according to the application example, at least a part of the guard portion may extend toward a side surface of the case.

According to this application example, even when stress is applied to the case and the bottom portion of the case is deformed or displaced, the side surface of the case comes into contact with the extension portion, and thus further deformation or displacement of the case is stopped. Therefore, it is possible to prevent the case from being damaged or deformed. Further, since the hand of the user can be prevented from inserting into a lower portion of the bottom portion of the case and the bottom portion of the case can be prevented from being grasped by the hand, it is possible to prevent the case from being damaged since the user holds the lower portion of the case directly.

Application Example 3

In the recording apparatus according to the application example, a gap may be formed between the guard portion and the case.

According to this application example, when the user grasps the guard portion with his or her hand and attempts to lift the recording apparatus, a force acting on the guard portion is blocked by the gap, and thus the force does not reach the case. Accordingly, it is possible to prevent the case from being deformed or damaged.

Application Example 4

In the recording apparatus according to the application example, a distance of the gap in a height direction may be set to be longer gradually from a side of the chassis to an opposite side to the chassis.

According to this application example, when the user grasps the guard portion with his or her hand and attempts to lift the recording apparatus, it is possible to prevent the guard portion from being inclined upward so that the opposite side of the guard portion to the chassis does not come into contact with the case. Accordingly, it is possible to prevent a lifting force acting on the guard portion from reaching the case.

Application Example 5

In the recording apparatus according to the application example, an area of a top surface of the guard portion may be equal to or greater than an area of a bottom surface of the case and the guard portion may be disposed in a region facing the bottom surface of the case.

According to this application example, the hand of the user can be prevented from being inserted into a lower portion of the case and the lower portion of the case can be prevent from being grasped by the hand.

Application Example 6

In the recording apparatus according to the application example, the guard portion may be installed to be detachably mounted on the chassis. The recording apparatus may further include: a concave portion provided in the chassis; and an engagement portion provided in the guard portion and inserted into the concave portion to engage with the concave portion.

According to this application example, the guard portion can be fixed to the chassis. Thus, the user can grasp the guard portion with his or her hand and lift the recording apparatus to move the recording apparatus.

Application Example 7

In the recording apparatus according to the application example, a position of a lower end of the engagement portion of the guard portion may be located at a position of a bottom surface of the chassis.

According to this application example, the position of the bottom surface of the case can be lowered. Thus, the amount of liquid contained in the liquid container accommodated in the case can be increased.

Application Example 8

In the recording apparatus according to the application example, the guard portion may be formed to be integrated into the chassis.

According to this application example, it is possible to prevent the manufacturing cost from increasing.

Application Example 9

In the recording apparatus according to the application example, the guard portion may include a metal frame and the metal frame may be fixed to a metal frame of the chassis.

According to this application example, the guard portion with the high rigidity is configured, and thus the guard portion can be strongly fixed to the chassis.

Application Example 10

In the recording apparatus according to the application example, the cases and the guard portions may be included on both sides of the chassis.

According to this application example, since the number of liquid containers accommodated in the case increases, the amounts of liquid contained in the liquid containers increase.

Application Example 11

In the recording apparatus according to the application example, one of the guard portions may be molded to be integrated into the chassis and the other of the guard portions may be installed to be detachably mounted on the chassis.

According to this application example, it is possible to prevent the manufacturing cost of the recording apparatus from increasing.

Application Example 12

In the recording apparatus according to the application example, a finger-grip portion gripped by a finger may be formed in the guard portion.

According to this application example, the user can stably hold the guard portion.

Application Example 13

In the recording apparatus according to the application example, the liquid container may be flexible.

According to this application example, since the liquid container is contracted according to consumption of the liquid, it is possible to prevent the liquid from not being supplied to the recording head since the inside of the liquid container becomes negatively pressurized.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1A:
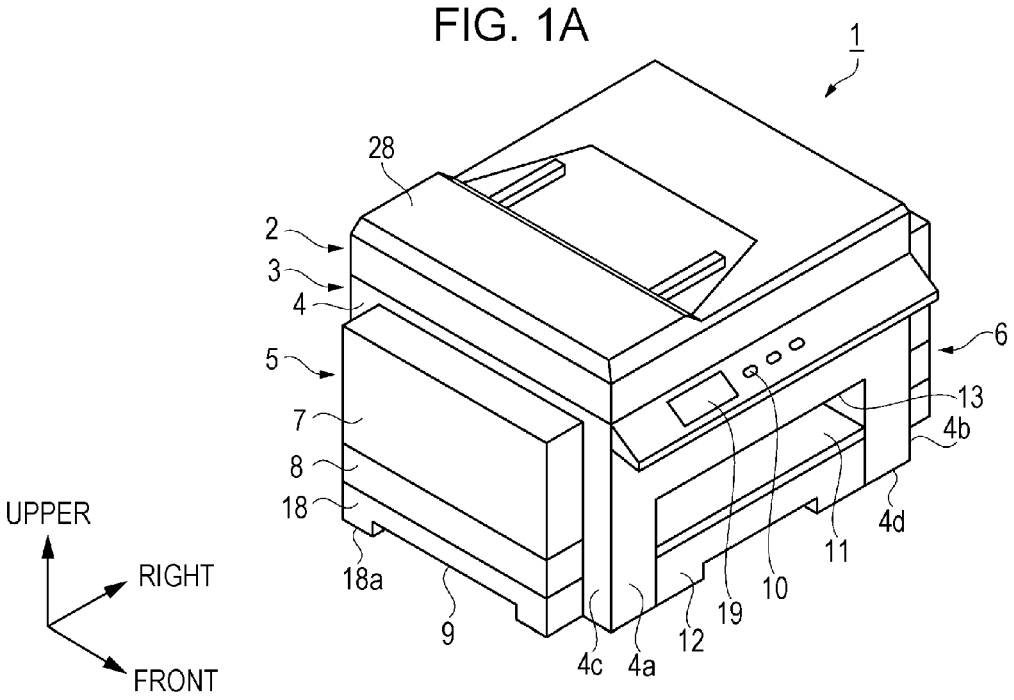
FIGS. 1A and 1B are perspective views illustrating the outer appearance of a recording apparatus.

Hereinafter, an embodiment of a recording apparatus will be described with reference to the drawings. FIG. 1A is a perspective view illustrating the outer appearance of an ink jet printer (hereinafter referred to as a printer) 1 which is a recording apparatus according to the embodiment when viewed from the front left side. The printer 1 includes a printing unit 3 that forms an image by ejecting ink (liquid), a reading unit 2 that reads a document or the like (not illustrated), and cases 5 and 6. An apparatus body is formed by the printing unit 3 and the reading unit 2.

The case 5 is detachably mounted on a side surface 4*c* on the left side of a chassis 4 of the apparatus body and the case 6 is detachably mounted on a side surface 4*b* on the right side of the chassis 4. The cases 5 and 6 accommodate ink containers 30 (see FIG. 3) each serving as a liquid container that contains ink. The case 5 accommodates one ink container 30 that contains monochromatic ink. The case 6 accommodates three ink containers 30 that contain color ink such as yellow ink, magenta ink, and cyan ink.

The reading unit 2 is disposed above the printing unit 3. The reading unit 2 includes a document platen (not illustrated) formed of a transparent plate-shaped member such as glass and can read a document placed on the document platen. An auto document feeder 28 connected to an upper end portion of the rear surface of the reading unit 2 via a hinge portion (not illustrated) is disposed above the reading unit 2. The auto document feeder 28 can sequentially feed a plurality of stacked documents to a reading window (not illustrated) formed of a transparent plate-shaped member such as glass while reversing the documents one by one so that the documents are read.

An opening 13 is formed on a side surface 4*a* of the chassis 4 on the front side. In a lower-side area of the opening 13, a sheet cassette 12 serving as a recording medium holding unit is installed to be inserted and extracted in front and rear directions. That is, the lower-side area of the opening 13 serves as an insertion port through which the sheet cassette 12 is detachably mounted on the chassis 4. A transport path 11 through which a sheet (not illustrated) printed inside the printing unit 3 is transported is provided above the sheet cassette 12. A discharge port of the printed sheet is formed in the upper-side area of the opening 13.

A plurality of sheets are placed in a stacking manner in the sheet cassette 12. The sheets placed in the sheet cassette 12 are supplied one by one to the inside of the chassis 4, and then the printed sheet is discharged from the discharge port formed on the upper side of the opening 13 and is placed on a discharge tray (not illustrated).

Operation buttons 10 used to perform an operation of turning the power on or off or setting or the like of a printing condition or a reading condition are included on the front side of the apparatus body. A display unit 19 formed of a liquid crystal panel displaying the printing condition or the reading condition is included on the front side of the apparatus body.

Figure 2:
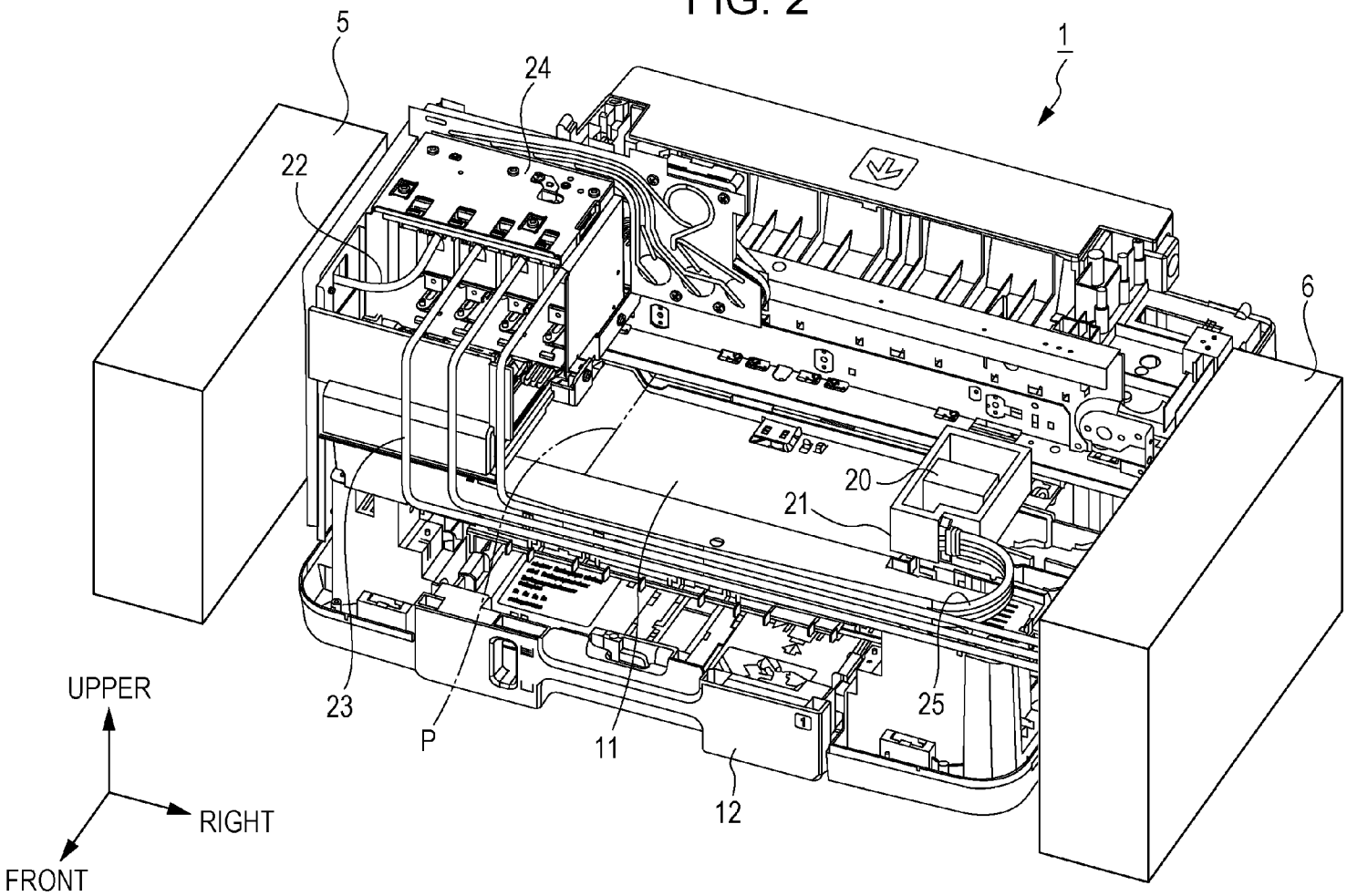
FIG. 2 is a perspective view illustrating the recording apparatus when the upper portion of a chassis is detached.

FIG. 2 is a perspective view illustrating the printer 1 when the upper portion of the chassis 4 is detached. A carriage 21 which can reciprocate in the right and left directions which are a main scanning direction is included above the transport path 11. A recording head 20 ejecting ink is included inside the carriage 21 to be exposed from the lower surface of the carriage 21.

The printing unit 3 includes a reversing unit (not illustrated) that reverses a sheet, and thus sheets P in the sheet cassette 12 included on the lower side of the transport path 11 are fed one by one from the rear side to the transport path 11 while being reversed by the reversing unit.

The printing unit 3 includes a transport unit configured to include a transport roller and a sheet feeding motor (none of which are illustrated), and thus the sheet P is transported from the rear side to the front side along the transport path 11 by the transport unit. The sheet P is printed by ejecting the ink toward the transported sheet P from the recording head 20 which is included in the carriage 21 and reciprocates.

As described above, the sheets P printed on the transport path 11 are sequentially discharged from the discharge port of the opening 13 formed in the region above the sheet cassette 12.

Four hollow ink supply needles (not illustrated) arranged in the right and left directions are included inside a holder case 24 with a rectangular box shape of which the front side is opened.

Each ink supply needle extends in the front and rear directions and penetrates through a side wall of the holder case 24. One end side of a flexible ink supply tube 25 is connected to a rear end portion of each ink supply needle and the other end side of the ink supply tube 25 is connected to the recording head 20.

Figure 3:
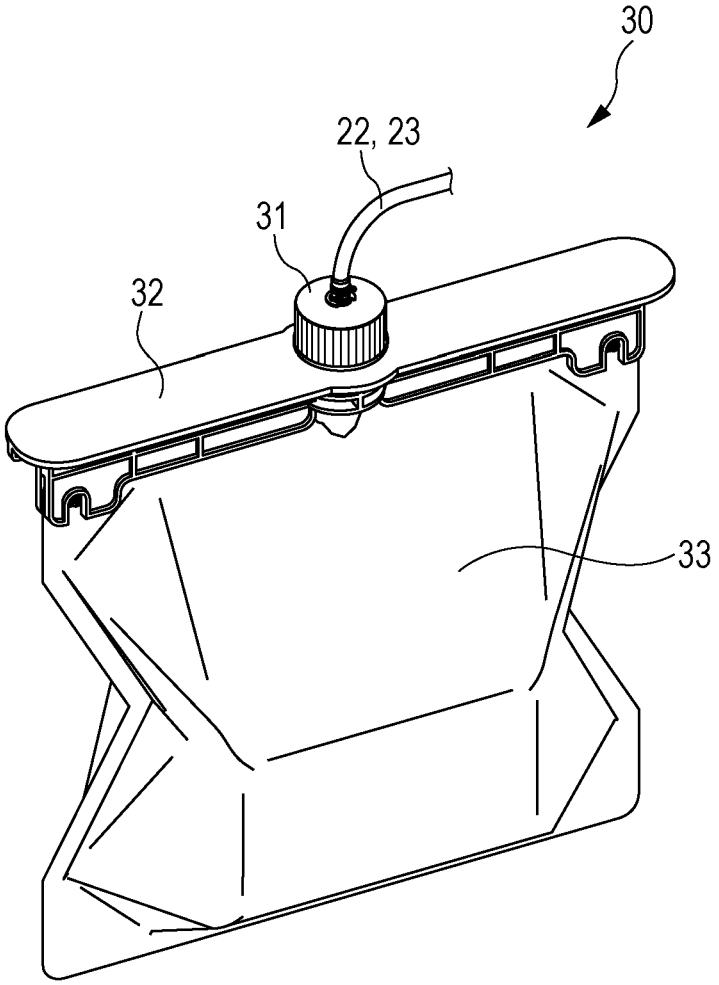
FIG. 3 is a perspective view illustrating an ink container.

One end side of one flexible connection tube 22 is connected to a front end portion of the ink supply needle and the other end side of the connection tube 22 is connected to the ink container 30 accommodated in the case 5 (see FIG. 3).

One end side of each of three flexible connection tubes 23 is connected to the front end portion of each ink supply needle and the other end side of each of the connection tubes 23 is connected to the ink container 30 stored in the case 6 (see FIG. 3).

FIG. 3 is a perspective view illustrating the ink container 30. The ink container 30 includes an ink bag 33 containing ink. A support member (hanger member) 32 is fixed to the upper end side of the ink bag 33.

The ink bag 33 is formed by interposing a tubular ink lead-out portion (not illustrated) between the edges of two rectangular flexible films and welding the edges of the two flexible films in this state.

A valve portion (not illustrated) is formed in an upper portion of the ink container 30. The valve portion operates by rotating a cap 31 in a depressing direction so that the inside of the ink container 30 and the connection tube 22 or 23 enter a communication state.

The monochromatic ink is supplied from the ink container 30 accommodated in the case 5 in FIG. 2 to the recording head 20 via the connection tube 22, the ink supply needle, and the ink supply tube 25. Further, the color ink, i.e., the yellow ink, the magenta ink, and the cyan link, are each supplied from the ink containers 30 accommodated in the case 6 to the recording head 20 via the connection tubes 23, the ink supply needles, and the ink supply tubes 25.

The case 5 in FIG. 1A includes a fixing portion 8 that fixes the case 5 to the side surface 4*c* of the chassis 4 and a cover 7 that can be opened and closed so that the ink container 30 is attached to and detached from the inside of the case 5. A guard portion 18 is included on the lower side of the fixing portion 8. A finger-grip portion 9 gripped by the fingers of a user is formed in the guard portion 18. The position of a bottom surface 18*a* of the guard portion 18 is the same as the position of a bottom surface 4*d* of the chassis 4 in the height direction.

Figure 1B:
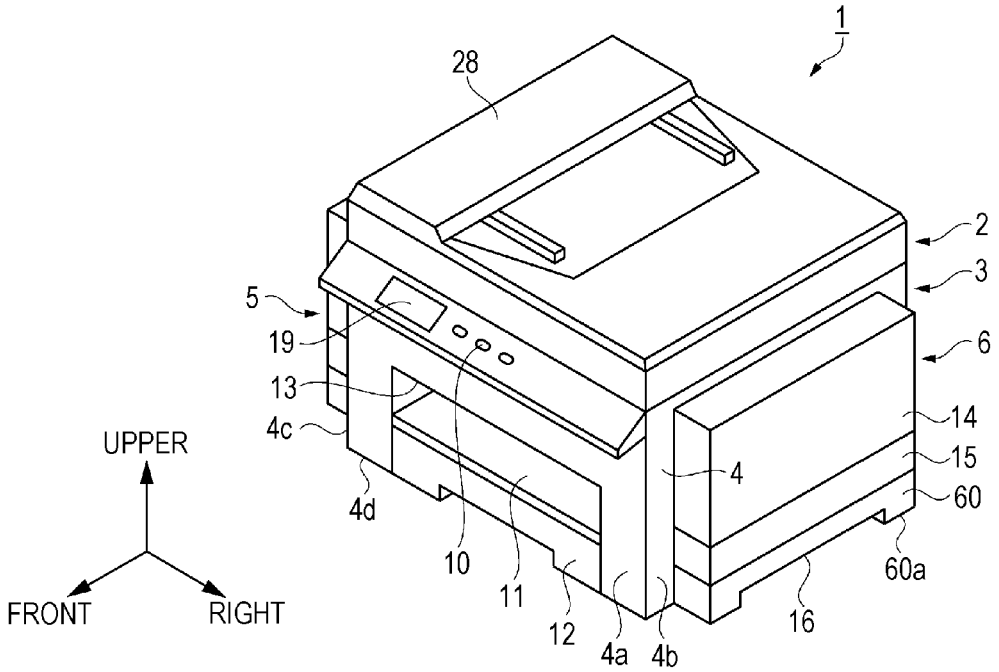

FIG. 1B is a perspective view illustrating the outer appearance of the printer 1 when viewed from the front right side. The case 6 includes a fixing portion 15 that fixes the case 6 to the side surface 4*b* of the chassis 4 and a cover 14 that can be opened and closed so that the ink container 30 is attached to and detached from the inside of the case 6. A guard portion 60 is included on the lower side of the fixing portion 15. A finger-grip portion 16 gripped by the fingers of the user is formed in the guard portion 60. The position of a bottom surface 60*a* of the guard portion 60 is the same as the position of a bottom surface 4*d* of the chassis 4 in the height direction.

The positions of the top surfaces of the cases 5 and 6 are located below the position of the document platen of the reading unit 2. Thus, the cases 5 and 6 are not hindered when the user pivots the auto document feeder 28 to expose the document platen and puts a document on the document platen or removes a document from the document platen.

Figure 4A:
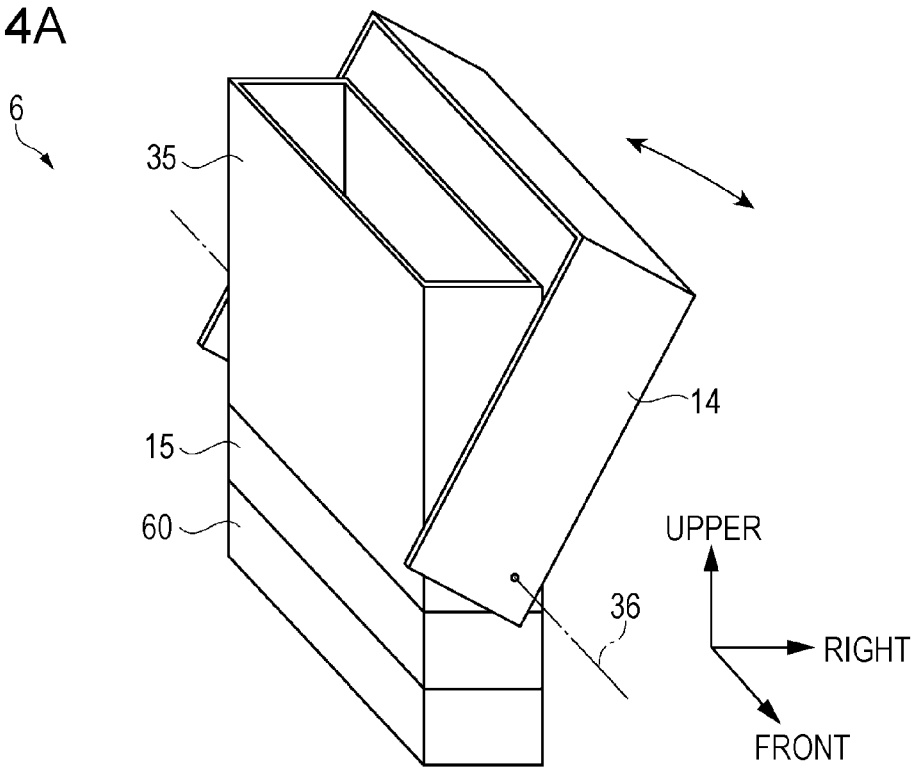
FIG. 4A is a perspective view illustrating the outer appearance of a case.

FIG. 4A is a perspective view illustrating the outer appearance of the case 6. The case 6 includes an accommodation portion 35 that accommodates the ink container 30. A lower end of the accommodation portion 35 is fixed to the fixing portion 15. The upper side of the accommodation portion 35 is opened so that the user can attach the ink container 30 to the inside of the accommodation portion 35 or detach the ink container 30 from the inside of the accommodation portion 35.

The cover 14 is included which can be pivoted about a pivoting axis 36 indicated by a one-dot chain line in an arrow direction. The cover 14 on the side of the chassis 4 is opened. By pivoting the cover 14 from a state of FIG. 4A so that the cover 14 becomes a closed state of FIG. 1B, the cover 14 covers the accommodation portion 35.

Figure 4B:
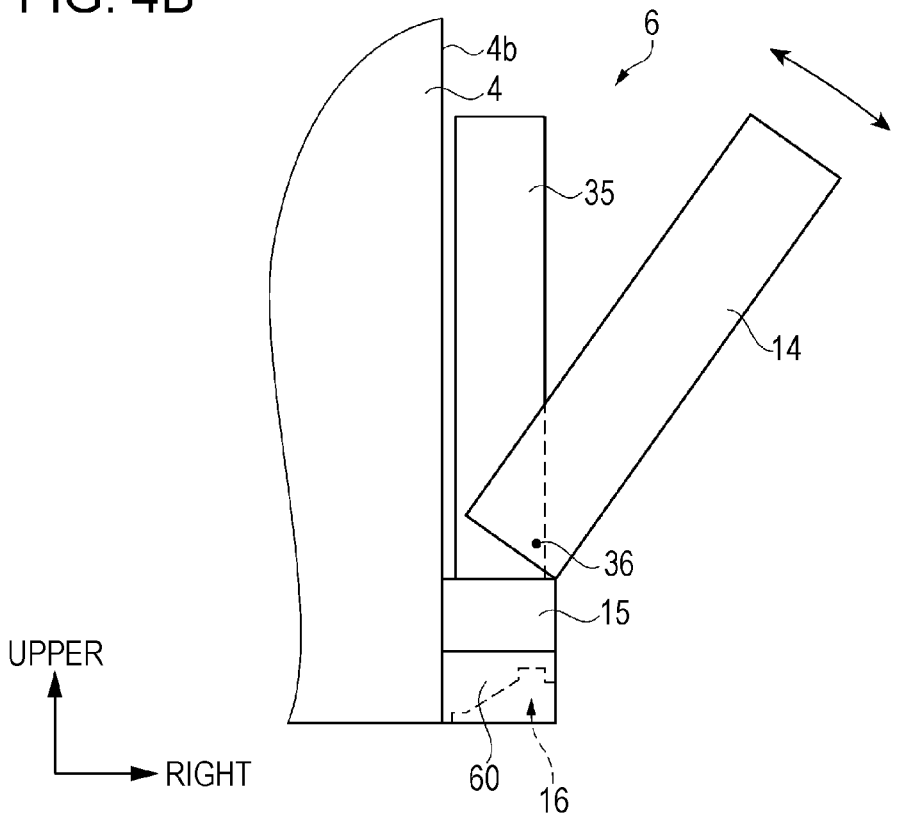
FIG. 4B is a diagram illustrating a portion in which the case and a guard portion are mounted on the chassis when viewed from the front side.

FIG. 4B is a diagram illustrating a portion in which the case 6 and the guard portion 60 are mounted on the chassis 4 when viewed from the front side. As illustrated in FIG. 1B, the finger-grip portion 16 extending in the front and rear sides is formed in the guard portion 60.

Figure 5:
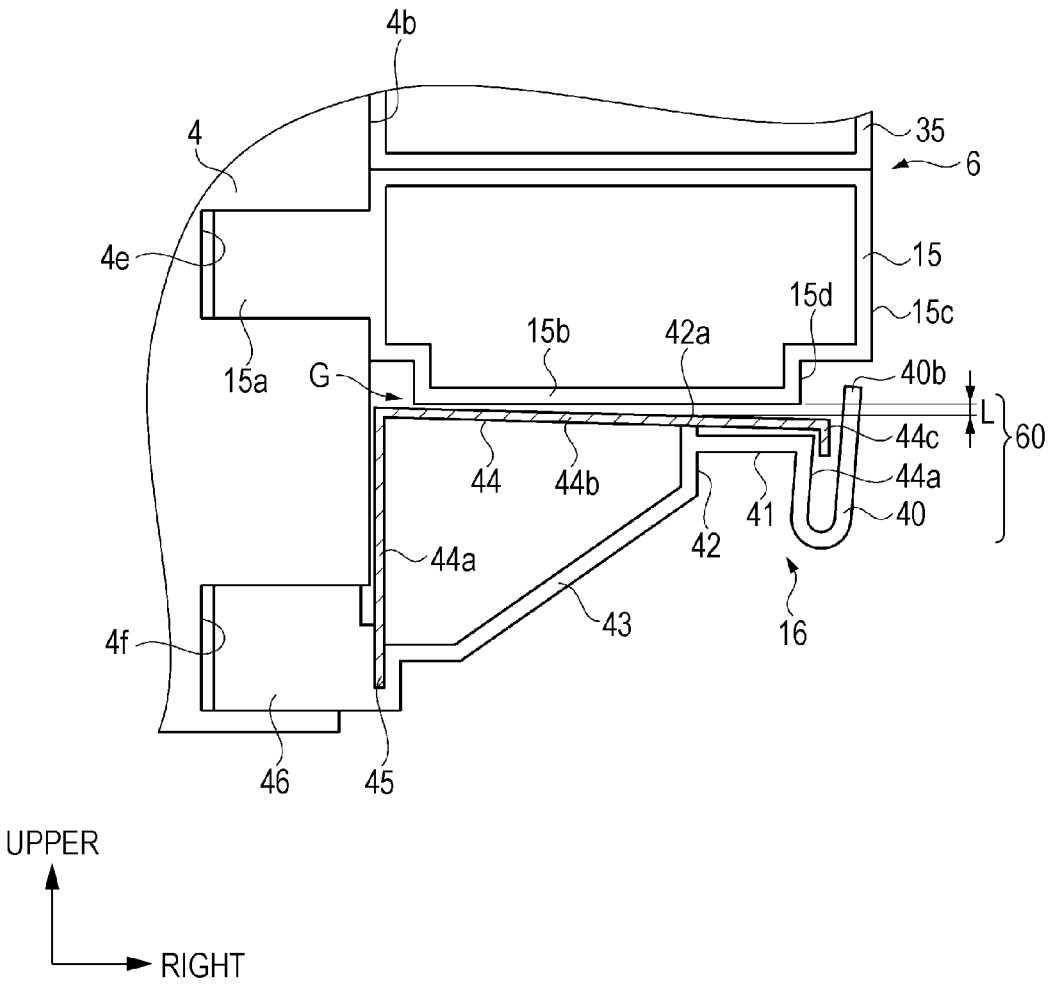
FIG. 5 is an expanded sectional view illustrating a fixing portion of the case and a part of the guard portion installed on the lower side of the case.

FIG. 5 is an expanded view illustrating the fixing unit 15 of the case 6 and the guard portion 60 installed on the lower side of the case 6 and is a sectional view when viewed from the front side. In the chassis 4, a recessed concave portion 4*e* is formed inward from the side surface 4*b* in the chassis 4 and a protrusion portion 15*a* protruding outward and serving as an engagement portion is formed in the fixing portion 15 of the case 6, so that the protrusion portion 15*a* of the fixing portion 15 is inserted to engage with the concave portion 4*e*.

The guard portion 60 is installed on the lower side of the fixing portion 15. The guard portion 60 includes a facing member 44 (member indicated by oblique lines) which is a metal plate-shaped member, a support portion 43 that supports the facing member 44, and a protrusion portion 46 that protrudes and is connected to the support portion 43.

The facing member 44 includes a horizontal plate portion 44*b* that is installed at a position facing a bottom wall 15*b* of the fixing portion 15 and extends in the right and left directions, a front end portion 44*c* that protrudes downward and is located at a position outside of the horizontal plate portion 44*b*, and a vertical plate portion 44*a* that extends in the upper and lower directions along the side surface 4*b* of the chassis 4.

A protrusion portion 40 that has a wall surface 40*a* curved in a U-shape and protruding downward is formed in the support portion 43. An extension portion 40*b* extending more upward than the facing member 44 is formed on the outside (right side) of the protrusion portion 40. The extension portion 40*b* is located more inward than and below a side surface 15*c* of the fixing portion 15 and more outward than a side surface 15*d* connected to the bottom wall 15*b*, and the extension portion 40*b* is disposed at a position overlapping the side surface 15*d* in the upper and lower directions.

A wall surface 41 extending in the right and left directions and a wall surface 42 connected to the wall surface 41 and extending in the upper and lower direction are formed on the side of the chassis 4 of the protrusion portion 40. A groove portion opened downward is formed by the protrusion portion 40 and the wall surfaces 41 and 42 on the side of the chassis 4 of the protrusion portion 40.

The user can hold the protrusion portion 40 by facing his or her palm upward, inserting a plurality of his or her fingers in the lower side of the protrusion portion 40 from the right side of the drawing, and bringing the front ends of the fingers into contact with the wall surface 41. That is, the finger-grip portion 16 is formed by the protrusion portion 40 and the wall surfaces 41 and 42.

The vertical plate portion 44*a* of the facing member 44 is inserted to be fixed to a groove portion 45 formed in the support portion 43. The horizontal plate portion 44*b* of the facing member 44 comes into contact with a protrusion surface 42*a* protruding above the wall surface 42 to be supported.

The protrusion portion 46 serving as an engagement portion protruding from the vertical plate portion 44*a* to the chassis 4 for engagement is formed in the support portion 43. In the chassis 4, a recessed concave portion 4*f* is formed inward from the side surface 4*b*. The protrusion portion 46 is inserted into the concave portion 4*f*, so that the guard portion 60 engages with the chassis 4.

A gap G extending in the right and left directions is formed between the bottom wall 15*b* of the fixing portion 15 and the horizontal plate portion 44*b* of the facing member 44. A distance L of the gap G in the upper and lower directions is set to be longer gradually from the side of the chassis 4 to an opposite side to the chassis 4.

The case 6 according to the embodiment is made of a resin material. The facing member 44 included in the guard portion 60 is made of a metal material so that the rigidity of the guard portion 60 is configured to be higher than the rigidity of the case 6.

The configurations of the fixing portion 8 and the guard portion 18 of the case 5 in FIG. 1A are the same as the configurations of the fixing portion 15 and the guard portion 60 of the case 6 described above. Further, concave portions having the same configurations as the concave portions 4*e* and 4*f* formed in the lower portion of the side surface 4*b* in FIG. 5 are formed in the side surface 4*c* of the case 4 on which the case 5 is mounted, and thus a protrusion portion of the fixing portion 8 and a protrusion portion of the guard portion are inserted into the concave portions formed in the side surface 4*c* to engage with the concave portions.

As described above, the printer 1 according to the embodiment includes the recording head 20 which is able to eject the ink to the sheet P, the sheet cassette 12 which holds the sheets P, the transport unit which transports the sheet P to the recording head 20, the chassis 4 which accommodates the recording head 20 and the transport unit and into which the sheet cassette 12 is inserted, the opening portion 13 which is formed in the side surface 4*a* of the chassis 4 and through which the sheet cassette 12 is inserted, the ink containers 30 which contain the ink, the cases 5 and 6 which are detachably mounted on the side surfaces 4*b* and 4*c* adjacent to the side surface 4*a* in which the opening portion 13 of the chassis 4 is formed and accommodate the ink containers 30, and supply units (the connection tubes 22 and 23) which supply the ink from the ink containers 30 to the inside of the chassis 4. The guard portions 18 and 60 with the higher rigidity than the cases 5 and 6 are formed in lower portions of the cases 5 and 6.

In this configuration, the cases 5 and 6 can be prevented from being deformed or damaged when the user grasps the guard portions 18 and 60 with his or her hands, and then lifts and moves the printer 1 in which the cases 5 and 6 are mounted on the chassis 4. Therefore, since the rigidity of the cases 5 and 6 may not be high, it is possible to suppress an increase in the manufacturing cost of the printer 1 including the cases 5 and 6.

At least a part of the extension portion 40*b* which extends toward the side surface 15*d* of the case 6 is provided in the guard portion 60.

Thus, even when stress is applied to the case 6 and the bottom portion of the case 6 is deformed or displaced, the side surface 15*d* of the case 6 comes into contact with the extension portion 40*b*, and thus further deformation or displacement of the case 6 is stopped. Accordingly, it is possible to prevent the case 6 from being damaged or deformed. Further, since the hand of the user can be prevented from inserting into a lower portion of the bottom portion of the case 6 and the bottom portion of the case 6 can be prevented from being grasped by the hand, it is possible to prevent the case 6 from being damaged since the user directly holds the lower portion of the case 6.

The gap G is formed between the facing member 44 of the guard portion 60 and the fixing portion 15 of the case 6 in FIG. 5. Thus, when the user grasps the guard portion 60 with his or her hand and attempts to lift the printer 1, a force acting on the guard portion 60 is blocked by the gap G, and thus the force does not reach the case 6. Accordingly, it is possible to prevent the case 6 from being deformed or damaged.

The distance L of the gap G in the height direction is set to be longer gradually from the side of the chassis 4 to the opposite side to the chassis 4.

Thus, when the user grasps the guard portion 60 with his or her hand and attempts to lift the printer 1, it is possible to prevent the guard portion 60 from being inclined upward due to stress applied to the guard portion 60 so that the opposite side (the front end portion 44*c* and the protrusion portion 40) of the guard portion 60 to the chassis 4 comes into contact with the case 6. Accordingly, it is possible to prevent a lifting force acting on the guard portion 60 from reaching the case 6, and thus it is possible to prevent the case 6 from being deformed or damaged.

The area of the top surface of the guard portion 60 is equal to or greater than the area of the bottom surface of the case 6, and the facing member 44 of the guard portion 60 is disposed in a region facing the bottom surface of the case 6. Accordingly, since the hands of the user can be prevented from being inserted into the lower portions of the cases 5 and 6 and the lower portions of the cases 5 and 6 can be prevented from being grasped by the hands, it is possible to prevent the cases 5 and 6 from being damaged when the user directly holds the lower portions of the cases 5 and 6.

When the user presses the cases 5 and 6 from the upper side and the cases 5 and 6 are deformed or displaced so that the bottom portions of the cases 5 and 6 come into contact with the guard portions 18 and 60, the cases 5 and 6 are supported from the lower side by the guard portions 18 and 60, so that further deformation or displacement is stopped in the cases 5 and 6. Accordingly, it is possible to prevent the cases 5 and 6 from being damaged.

The guard portion 60 is provided to be detachably mounted on the chassis 4. The recessed concave portion 4*f* is formed inward in the chassis 4 and the protrusion portion 46 protruding outward is formed in the guard portion 60. The protrusion portion 46 of the guard portion 60 is inserted to engage with the concave portion 4*f* of the chassis 4.

Thus, the guard portion 60 can be fixed to the chassis 4. Accordingly, when the protrusion portion 46 of the guard portion 60 is inserted to engage with the concave portion 4*f* of the chassis 4, the user can grasp the guard portion 60 with his or her hand and lift the printer 1 to move the printer 1.

The position of the lower end of the protrusion portion 46 serving as the engagement portion of the guard portion 60 may be located at the position of the bottom surface 4*d* of the chassis 4. Thus, when the position of the guard portion 60 is located below, the position of the bottom surface of the case 6 can be lowered. Accordingly, since the lengths of the cases 5 and 6 in the height direction can be long, the amounts of ink contained in the ink containers 30 accommodated in the cases 5 and 6 can be increased.

In the guard portion 60, the facing member 44, the support portion 43, and the protrusion portion 46 may be formed of metal or resin to be integrated. Thus, since the assembly cost of the components is unnecessary, it is possible to prevent the manufacturing cost from increasing.

The finger-grip portion 16 gripped by the fingers is formed in the guard portion 60. Thus, the user can stably hold the guard portion 60.

The cases 5 and 6 are included on both sides of the chassis 4. Thus, since the number of ink containers 30 accommodated in the cases 5 and 6 increases, the amounts of ink contained in the ink containers 30 increases.

When the guard portions are included on both sides of the chassis, one of the guard portions may be formed to be integrated into the chassis and the other of the guard portions may be provided to be detachably mounted on the chassis. Thus, for example, when only the case accommodating the ink container containing the monochromatic ink is mounted, the case is mounted on the upper side of the guard portion molded to be integrated into the chassis. Therefore, it is possible to suppress the manufacturing cost of the printer from increasing.

The ink container 30 is configured to include the ink bag 33 formed of a flexible film. Thus, since the ink bag 33 of the ink container 30 is contracted according to consumption of the ink, it is possible to prevent the ink from not being supplied to the recording head 20 since the inside of the ink container 30 is negatively pressurized.

Second Embodiment

Figure 6:
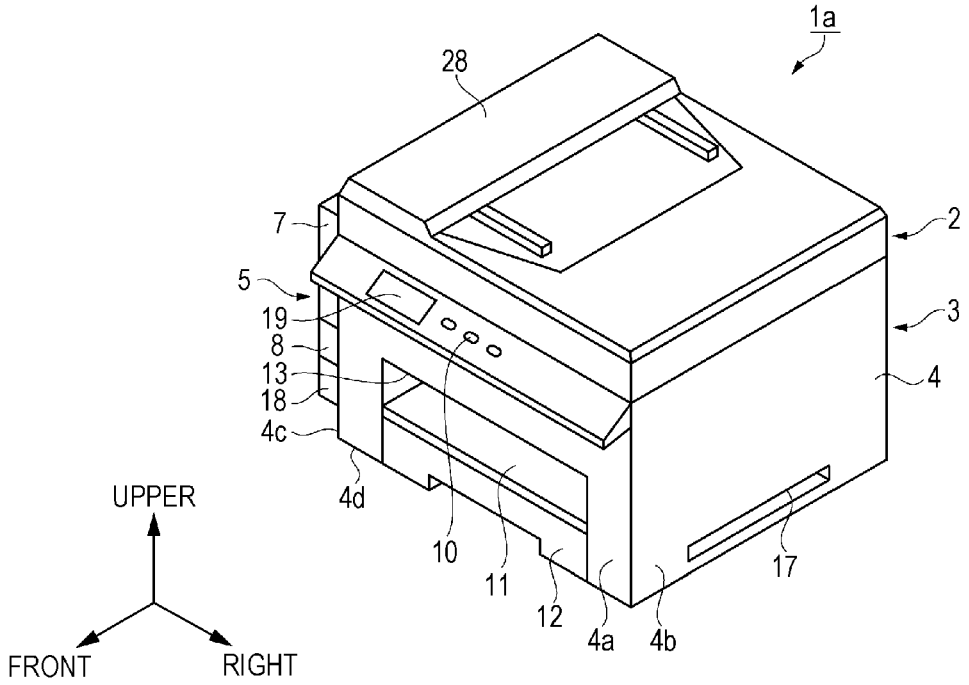
FIG. 6 is a perspective view illustrating the outer appearance of a recording apparatus according to a second embodiment.

In a second embodiment, a recording apparatus will be described in which a case is included on one side of a chassis and no case is included on the other side of the chassis. FIG. 6 is a perspective view illustrating the outer appearance of the recording apparatus according to the second embodiment.

FIG. 6 illustrates a printer 1*a* from which the case 6 included on the right side of the chassis 4 in FIG. 1B described in the first embodiment is detached. The case 5 is included on the side surface 4*c* of the left side of the chassis 4. The ink container 30 accommodated in the case 5 contains monochromatic ink. The printer 1*a* is a dedicated recording apparatus that uses the monochromatic ink.

The guard portion 18 including the finger-grip portion 9 (see FIG. 1A) described in the first embodiment is installed below the case 5. A finger-grip portion 17 is formed in a lower portion of the side surface 4*b* of the chassis 4. The finger-grip portion 17 is formed such that a recessed concave portion extends more inward than the side surface 4*b* in the front and rear directions.

In this configuration, the side on which no case is mounted on the chassis 4 can be held with a hand of a user. The remaining configuration of the printer 1*a* is the same as the configuration of the printer 1 described in the first embodiment.

Third Embodiment

Figure 7:
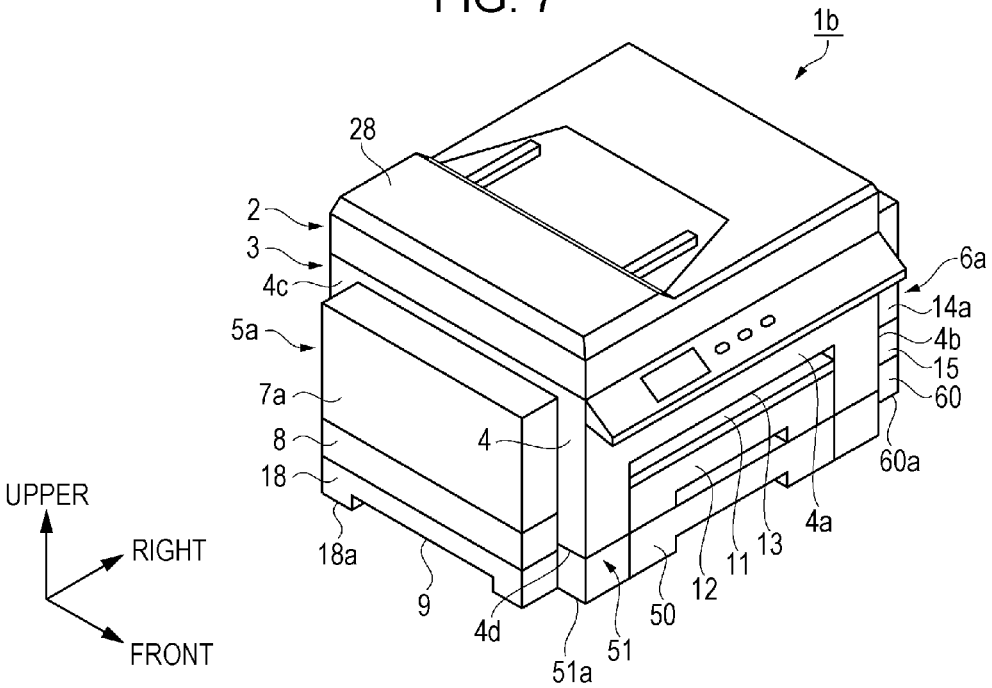
FIG. 7 is a perspective view illustrating the outer appearance of a recording apparatus according to a third embodiment.

In a third embodiment, a recording apparatus including an external recording medium holding unit will be described. FIG. 7 is a perspective view illustrating the outer appearance of a printer 1*b* according to the third embodiment.

The printer 1*b* includes an additional cassette unit 51 which is the external recording medium holding unit on the lower side of the apparatus body formed by the printing unit 3 and the reading unit 2 of the first embodiment. The printer 1*b* further includes a case 5*a* which can be detachably mounted on a side surface 4*c* of the left side of a chassis 4 and a case 6*a* which can be detachably mounted on a side surface 4*b* of the right side of the chassis 4.

A sheet cassette 50 which can be inserted and extracted in the front and rear directions is installed in the additional cassette unit 51. Sheets P are stacked in the sheet cassette 50 and the sheets P are fed one by one to the printing unit 3 by a feeding unit (not illustrated).

The position of a bottom surface 18*a* of a guard portion 18 is the same as the position of a bottom surface 51*a* of the additional cassette unit 51 in the height direction. Likewise, the position of a bottom surface 60*a* of a guard portion 60 is the same as the position of a bottom surface 51*a* of the additional cassette unit 51 in the height direction.

In this configuration, the positions of the bottom surfaces of fixing portions 8 and 15 of the cases 5*a* and 6*a* can be located at positions lower than the position of the bottom surface 4*d* of the chassis 4. Therefore, since the lengths of covers 7*a* and 14*a* in the height direction can be allowed to be long, the length of an accommodation portion 35 covered with each of the covers 7*a* and 14*a* can be allowed to be long. Thus, since the length of the ink container 30, which is accommodated in the accommodation portion 35, in the height direction can be allowed to be long, the amount of contained ink increases.

Fourth Embodiment

In a fourth embodiment, a printer in which a metal frame included in a guard portion is fixed to a metal frame of a chassis will be described. The outer appearance of the printer according to the embodiment is the same as the outer appearance of the printer 1 in FIGS. 1A and 1B described in the first embodiment.

As in the first embodiment, a case 6 according to the embodiment includes the cover 14 which can be pivoted in FIG. 4A, an accommodation portion 35 which accommodates the ink container 30 in FIG. 3, and a fixing portion 15 which fixes the accommodation portion 35. A guard portion 60 in which the finger-grip portion 16 in FIG. 4B is formed is included on the lower side of the case 6.

Figure 8:
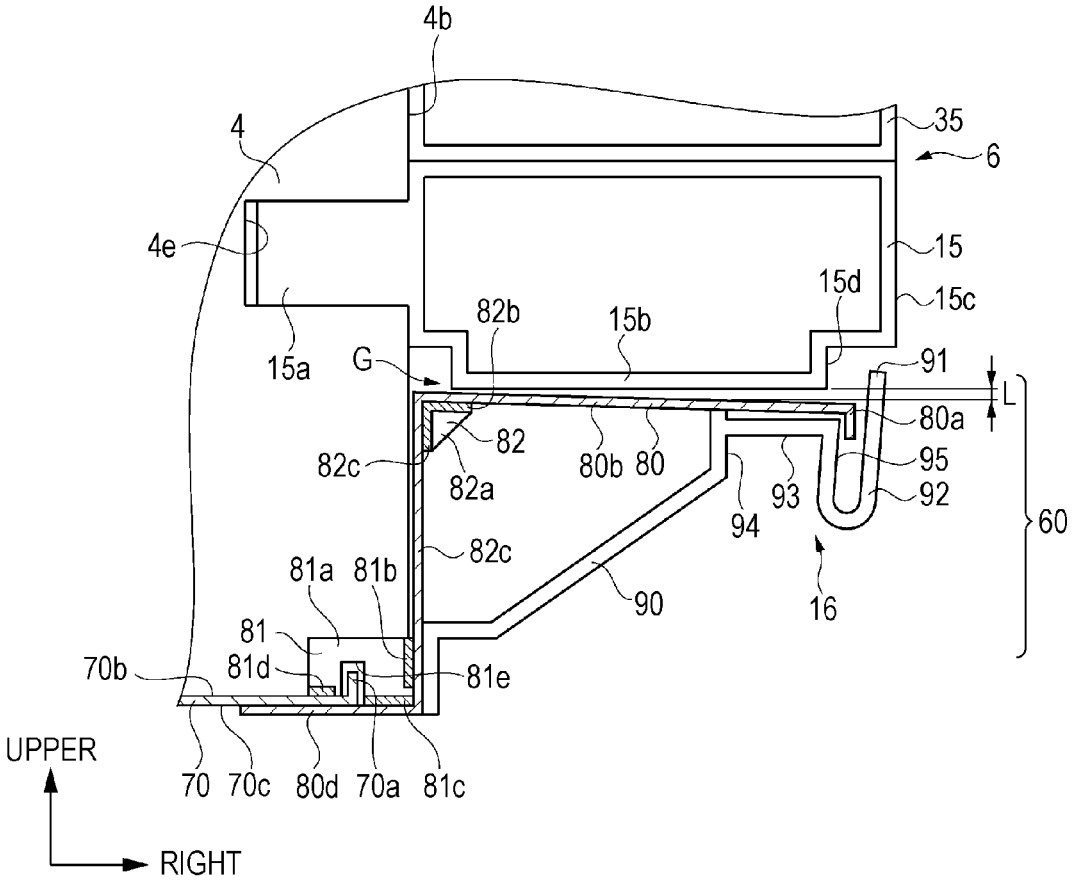
FIG. 8 is an expanded sectional view illustrating a fixing portion of the case and a part of the guard portion installed on the lower side of the case according to a fourth embodiment.

FIG. 8 is an expanded sectional view illustrating the fixing portion 15 of the case 6 and a part of the guard portion 60 installed on the lower side of the case 6, when viewed in the front direction. A protrusion portion 15*a* which can be inserted into or extracted from a concave portion 4*e* formed in the side surface 4*b* of the chassis 4 is formed in the fixing portion 15 of the case 6, and thus the case 6 is included to be detachably mounted on the chassis 4.

The guard portion 60 is installed on the lower side of the fixing portion 15. The guard portion 60 includes a facing member 80 (member indicated by oblique lines) made of metal and a cover portion 90 covering the facing member 80.

A protrusion portion 92 that has a wall surface 95 curved in a U-shape and protruding downward is formed in the cover portion 90. An extension portion 91 extending more upward than the facing member 80 is formed on the outside (right side of the drawing) of the protrusion portion 92. The extension portion 91 is located more inward than and below a side surface 15*c* of the fixing portion 15 and more outward than a side surface 15*d* connected to the bottom wall 15*b*, and the extension portion 91 is disposed at a position overlapping the side surface 15*d* in the upper and lower directions.

A wall surface 93 extending in the right and left directions and a wall surface 94 connected to the wall surface 93 and extending in the upper and lower direction are formed on the side of the chassis 4 of the protrusion portion 92. A groove portion opened downward is formed by the protrusion portion 92 and the wall surfaces 93 and 94 on the side of the chassis 4 of the protrusion portion 92.

The user can hold the protrusion portion 92 by facing his or her palm upward, inserting a plurality of his or her fingers in the lower side of the protrusion portion 92 from the right side of the drawing, and bringing the front ends of the fingers into contact with the wall surface 93. That is, the finger-grip portion 16 is formed by the protrusion portion 92 and the wall surfaces 93 and 94.

The facing member 80 includes a horizontal plate portion 80*b* that is installed at a position facing the bottom wall 15*b* of the fixing portion 15, a front end portion 80*a* that is located on the outside of the horizontal plate portion 80*b* and protrudes downward, a vertical plate portion 80*c* that extends in the upper and lower directions, and a bottom plate portion 80*d* that is connected to the lower side of the vertical plate portion 80*c*.

A gap G extending in the right and left directions is formed between the bottom wall 15*b* of the fixing portion 15 and the horizontal plate portion 80*b* of the facing member 80. A distance L of the gap G in the upper and lower directions is set to be longer gradually from the side of the chassis 4 to an opposite side to the chassis 4.

Figure 9A:
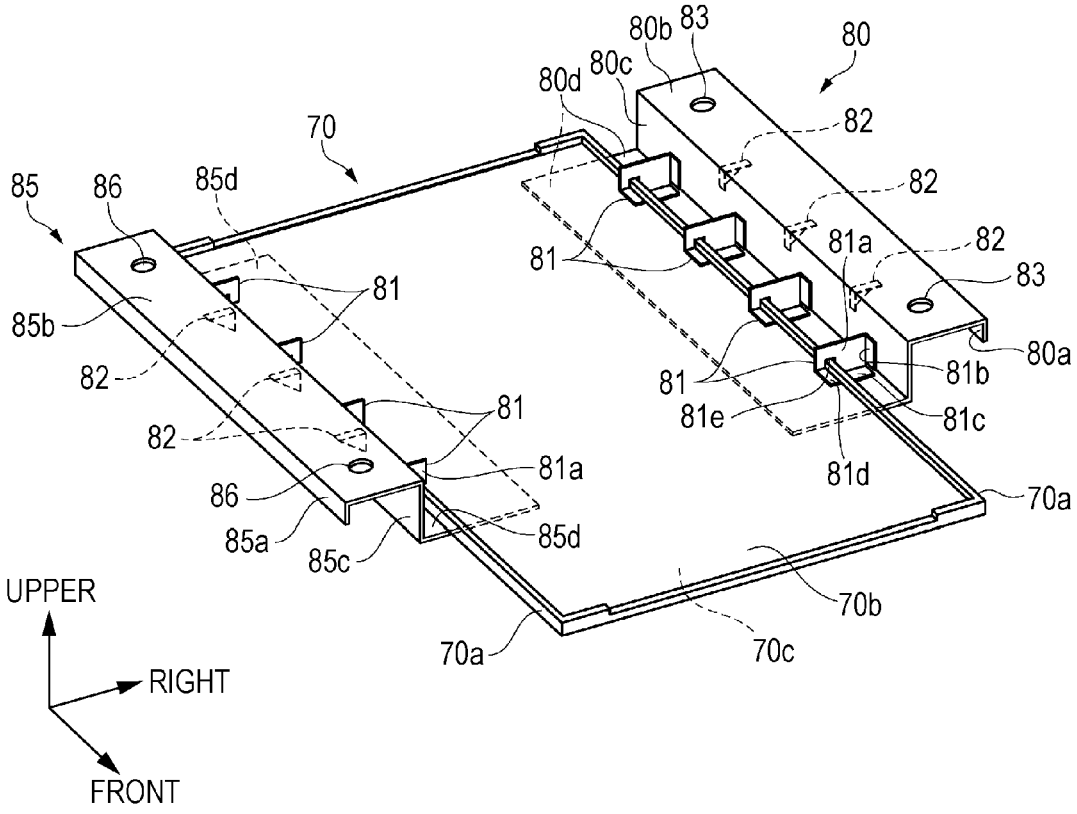
FIGS. 9A to 9C are perspective views illustrating a facing member fixed to a bottom plate of the chassis according to the fourth embodiment.

FIG. 9A is a perspective view illustrating the facing member 80 and a facing member 85 fixed to a bottom plate portion 70 of the chassis 4. A guard portion 18 with the same configuration as the guard portion 60 described with reference to FIG. 8 in the embodiment is also included in the lower side of the fixing portion 8 of the case 5 in FIG. 1A. The guard portion 18 includes the facing member 85.

As in the configuration of the facing member 80, the facing member 85 includes a horizontal plate portion 85*b* that is installed at a position facing the bottom wall (not illustrated) of the fixing portion 8, a front end portion 85*a* that is located on the outside (left side of the drawing) of the horizontal plate portion 85*b* and protrudes downward, a vertical plate portion 85*c* that extends in the upper and lower directions, and a bottom plate portion 85*d* that is connected to the lower side of the vertical plate portion 85*c*.

The bottom plate portion 70 forming the bottom portion of the chassis 4 is formed of a metal plate-shaped member. The bottom plate portions 80*d* and 85*d* of the facing members 80 and 85 are fixed to a lower surface 70*c* of the bottom plate portion 70 by welding (for example, spot welding). The bottom plate portions 80*d* and 85*d* may be fixed to the bottom plate portion 70 by screws.

Screw holes 83 are formed in the horizontal plate portion 80*b*, and thus screws penetrating through holes (not illustrated) formed in the cover portion 90 in FIG. 8 are screwed into the screw holes 83, so that the cover portion 90 is fixed to the horizontal plate portion 80*b*. Likewise, screw holes 86 are formed in the horizontal plate portion 85*b*, and thus the cover portion is fixed to the horizontal plate portion 85*b* by screws.

Figure 9B:
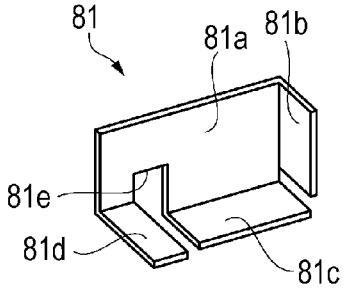

A plurality of reinforcement members 81 are included on the inside of the corner of the vertical plate portion 80*c* and the bottom plate portion 80*d*. FIG. 9B is a perspective view illustrating the reinforcement member 81. The reinforcement member 81 includes a plate-shaped main portion 81*a* and wall portions 81*b*, 81*c*, and 81*d* erected from the main portion 81*a*. In the main portion 81*a*, a notch portion 81*e* is formed between the wall portions 81*c* and 81*d*.

As illustrated in FIGS. 8 and 9A, the main portion 81*a* is included at a posture erected from the bottom plate portion 80*d*. The wall portion 81*d* is fixed to an upper surface 70*b* of the bottom plate portion 70 by welding (for example, spot welding). The wall portion 81*d* may be fixed to the bottom plate portion 70 by a screw.

The wall portion 81*b* comes into contact with the vertical plate portion 80*c* and the wall portion 81*c* comes into contact with the bottom plate portion 80*d*. A wall portion 70*a* erected from the upper surface 70*b* and extending along the end portion is formed in the end portion of the bottom plate portion 70. The reinforcement member 81 is disposed so that the wall portion 70*a* passes through notched portions 81*e*.

In this configuration, the corner of the vertical plate portion 80*c* and the bottom plate portion 80*d* of the facing member 80 can be prevented from being deformed when the user grasps the finger-grip portion 16 and lifts the printer according to the embodiment.

Likewise, a plurality of reinforcement members 81 of which main portions 81*a* are erected from the bottom plate portion 85*d* are included on the inside of the corner of the vertical plate portion 85*c* and the bottom plate portion 85*d*. Thus, the corner of the vertical plate portion 85*c* and the bottom plate portion 85*d* of the facing member 85 can be prevented from being deformed when the user takes the finger-grip portion 9 in FIG. 1A and lifts the printer according to the embodiment.

Figure 9C:
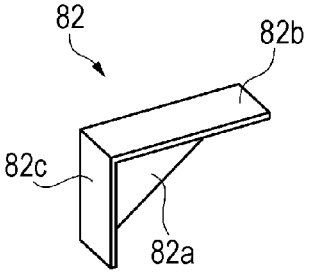

As illustrated in FIGS. 8 and 9A, a plurality of reinforcement members 82 are included on the inside of the corner of the horizontal plate portion 80*b* and the vertical plate portion 80*c*. FIG. 9C is a perspective view illustrating the reinforcement member 82. The reinforcement member 82 includes a plate-shaped main portion 82*a* and wall portions 82*b* and 82*c* erected from the main portion 82*a*. The reinforcement member 82 is included at a posture at which the main portion 82*a* is erected downward from the horizontal plate portion 80*b*.

The wall portion 82*b* is fixed to the horizontal plate portion 80*b* by welding (for example, spot welding) and the wall portion 82*c* comes into contact with the vertical plate portion 80*c*. The wall portion 82*b* may be fixed to the horizontal plate portion 80*b* by a screw. In this configuration, the corner of the horizontal plate portion 80*b* and the vertical plate portion 80*c* of the facing member 80 can be prevented from being deformed when the user takes the finger-grip portion 16 and lifts the printer according to the embodiment.

Likewise, a plurality of reinforcement members 82 of which main portions 82*a* are erected downward from the horizontal plate portion 85*b* are included on the inside of the corner of the horizontal plate portion 85*b* and the vertical plate portion 85*c*. Thus, the corner of the horizontal plate portion 85*b* and the vertical plate portion 85*c* of the facing member 85 can be prevented from being deformed when the user takes the finger-grip portion 9 in FIG. 1A and lifts the printer according to the embodiment. The reinforcement members 82 may not be included. The remaining configuration of the printer according to the embodiment is the same as the configuration described in the first embodiment.

The guard portions 18 and 60 described in the embodiment include the facing members 80 and 85 which are the metal frames. The facing members 80 and 85 are fixed to the bottom plate portion 70 which is the metal frame of the chassis 4. In this configuration, the guard portions 18 and 60 with high rigidity are formed and the guard portions 18 and 60 are strongly fixed to the chassis 4.

The entire disclosure of Japanese Patent Application No.: 2013-203488, filed Sep. 30, 2013 and 2014-029348, filed Feb. 19, 2014 are expressly incorporated by reference herein.

What is claimed is:

1. A recording apparatus comprising:

a recording head that is able to eject a liquid to a recording medium;

a recording medium holding unit that holds the recording medium;

a transport unit that transports the recording medium to the recording head;

a chassis having an internal space which contains the recording head and the transport unit and into which the recording medium holding unit is inserted;

an insertion port which is formed in a side surface of the chassis and through which the recording medium holding unit is inserted;

a liquid container that contains the liquid;

a case that is mounted on an external side of one side surface adjacent to the side surface in which the insertion port of the chassis is formed and accommodates the liquid container; and a supply unit that supplies the liquid from the liquid container to an inside of the chassis, wherein a guard portion with higher rigidity than the case is formed on a lower side of the case.

2. The recording apparatus according to claim 1, wherein at least a part of the guard portion extends toward a side surface of the case.

3. The recording apparatus according to claim 1, wherein a gap is formed between the guard portion and the case.

4. The recording apparatus according to claim 3, wherein a distance of the gap in a height direction is set to be longer gradually from a side of the chassis to an opposite side to the chassis.

5. The recording apparatus according to claim 1, wherein an area of a top surface of the guard portion is equal to or greater than an area of a bottom surface of the case and the guard portion is disposed in a region facing the bottom surface of the case.

6. The recording apparatus according to claim 1, wherein the guard portion is installed to be detachably mounted on the chassis, and wherein the recording apparatus further comprises:

a concave portion provided in the chassis; and an engagement portion provided in the guard portion and inserted into the concave portion to engage with the concave portion.

7. The recording apparatus according to claim 6, wherein a position of a lower end of the engagement portion of the guard portion is located at a position of a bottom surface of the chassis.

8. The recording apparatus according to claim 1, wherein the guard portion is formed to be integrated into the chassis.

9. The recording apparatus according to claim 1, wherein the guard portion includes a metal frame and the metal frame is fixed to a metal frame of the chassis.

10. The recording apparatus according to claim 1, wherein a finger-grip portion gripped by a finger is formed in the guard portion.

11. The recording apparatus according to claim 1, wherein the liquid container is flexible.

12. A recording apparatus comprising:

a recording head that is able to eject a liquid to a recording medium;

a recording medium holding unit that holds the recording medium;

a transport unit that transports the recording medium to the recording head;

a chassis having an internal space which contains the recording head and the transport unit and into which the recording medium holding unit is inserted;

an insertion port which is formed in a side surface of the chassis and through which the recording medium holding unit is inserted;

a liquid container that contains the liquid;

cases that are mounted on an external side of both side surfaces adjacent to the side surface in which the insertion port of the chassis is formed and accommodates the liquid container; and a supply unit that supplies the liquid from the liquid container to an inside of the chassis, wherein guard portions with higher rigidity than the case is formed on lower sides of the case.

13. The recording apparatus according to claim 12, wherein one of the guard portions is molded to be integrated into the chassis and the other of the guard portions is installed to be detachably mounted on the chassis.

* * * * *